US011131489B2

(12) United States Patent
Domyo

(10) Patent No.: US 11,131,489 B2
(45) Date of Patent: Sep. 28, 2021

(54) REFRIGERANT RECOVERY APPARATUS

(71) Applicant: DAIKIN INDUSTRIES, LTD., Osaka (JP)

(72) Inventor: Nobuo Domyo, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 111 days.

(21) Appl. No.: 16/628,943

(22) PCT Filed: Jun. 25, 2018

(86) PCT No.: PCT/JP2018/023965
§ 371 (c)(1),
(2) Date: Jan. 6, 2020

(87) PCT Pub. No.: WO2019/009117
PCT Pub. Date: Jan. 10, 2019

(65) Prior Publication Data

US 2020/0208889 A1 Jul. 2, 2020

(30) Foreign Application Priority Data

Jul. 7, 2017 (JP) ..... JP2017-133800

(51) Int. Cl.
*F25B 45/00* (2006.01)

(52) U.S. Cl.
CPC ..... *F25B 45/00* (2013.01)

(58) Field of Classification Search
CPC ..... F25B 45/00; F25B 2345/002
(Continued)

(56) References Cited

U.S. PATENT DOCUMENTS 4,476,688 A * 10/1984 Goddard ..... F25B 45/00 62/149
4,998,413 A * 3/1991 Sato ..... B60H 1/00585 62/149

(Continued)

FOREIGN PATENT DOCUMENTS

EP 0 379 211 A2 7/1990
JP 2-197773 A 8/1990

(Continued)

OTHER PUBLICATIONS

European Search Report of corresponding EP Application No. 18 82 8007.7 dated Feb. 9, 2021.

(Continued)

*Primary Examiner* — Ana M Vazquez
(74) *Attorney, Agent, or Firm* — Global IP Counselors, LLP

(57) ABSTRACT

A refrigerant recovery apparatus is connected between a target apparatus from which a refrigerant is recovered and a refrigerant recovery container. The apparatus includes a compressor, a condenser, and a residual refrigerant recovery path. The compressor sucks the refrigerant from a refrigerant circuit of the target apparatus and compresses the refrigerant. The condenser condenses the refrigerant discharged from the compressor and sends the refrigerant to the refrigerant recovery container through a main refrigerant recovery path. The residual refrigerant recovery path through which a decompression mechanism on a branch path branching from the main refrigerant recovery path decompresses a residual refrigerant in the condenser. The decompressed refrigerant is sucked into the compressor and pressurized. The pressurized refrigerant is sent into the refrigerant recovery container. An auxiliary heat exchanger is connectable near an outlet of the (Continued)

condenser and upstream of a junction between the main and branch paths.

4 Claims, 7 Drawing Sheets

(58) Field of Classification Search
USPC ..... 62/149, 292
See application file for complete search history.

(56) References Cited

U.S. PATENT DOCUMENTS

| | | | | |
|---|---|---|---|---|
| 5,241,834 | A | 9/1993 | Gill | |
| 5,617,731 | A * | 4/1997 | Scaringe | F25B 45/00 62/149 |
| 9,759,464 | B2 * | 9/2017 | Sanhaji | F25B 43/043 |

FOREIGN PATENT DOCUMENTS

| | | | |
|---|---|---|---|
| JP | 5-93559 | A | 4/1993 |
| JP | 2000-55514 | A | 2/2000 |
| JP | 3133622 | B2 | 2/2001 |
| JP | 2005-344988 | A | 12/2005 |
| JP | 2017-72284 | A | 4/2017 |

OTHER PUBLICATIONS

International Search Report of corresponding PCT Application No. PCT/JP2018/023965 dated Sep. 4, 2018.
International Preliminary Report of corresponding PCT Application No. PCT/JP2018/023965 dated Jan. 16, 2020.

* cited by examiner

REFRIGERANT RECOVERY APPARATUS

CROSS-REFERENCE TO RELATED APPLICATIONS

This U.S. National stage application claims priority under 35 U.S.C. § 119(a) to Japanese Patent Application No. 2017-133800, filed in Japan on Jul. 7, 2017, the entire contents of which are hereby incorporated herein by reference.

BACKGROUND

Field of the Invention

The present disclosure relates to a refrigerant recovery apparatus for sucking a refrigerant from a refrigerant circuit of a target apparatus from which the refrigerant is recovered, such as a refrigerator or an air conditioner, liquefying the sucked refrigerant, and discharging the liquefied refrigerant to a container or any other similar member for refrigerant recovery.

Background Information

A refrigerant has been recovered from an air conditioner or a refrigerator (a target apparatus from which the refrigerant is recovered), for example, if a broken component of a refrigerant circuit of the air conditioner or the refrigerator is to be repaired, or if the air conditioner or the refrigerator is to be relocated or to be removed. A refrigerant is recovered as described above after the target apparatus is connected to a refrigerant recovery apparatus and a refrigerant recovery container to build a refrigerant recovery system (see, for example, FIG. 5 of Japanese Unexamined Patent Publication No. 2005-3449881).

As shown in FIG. 6, a refrigerant recovery apparatus (30A) for use in a known refrigerant recovery system (5) is configured so that a casing (35) houses components, such as a compressor (31), a condenser (32), and switching valves (41, 42). The refrigerant recovery apparatus (30A) has its compressor (31) connected at the suction side thereof to a refrigerant circuit (21) of a target apparatus (20) from which a refrigerant is recovered, and has its condenser (32) connected at the outlet side thereof to a refrigerant recovery container (100).

In FIG. 6, in the refrigerant recovery apparatus (30A), the suction side of the compressor (31) is connected to an inlet (36) through a gas-side switching valve (41), and the discharge side of the compressor (31) is connected to an outlet (37) through a liquid-side switching valve (42), the condenser (32), and a check valve (46). The gas-side switching valve (41) and the liquid-side switching valve (42) are three-way valves each having a port (a black filled (closed) port in this figure) connected to the outlet side of the condenser (32).

The refrigerant circuit (21) of the target apparatus (20) includes a compressor (22), a condenser (23), a liquid receiver (24), an expansion valve (25), an evaporator (26), and an accumulator (27), and is a closed circuit in which these components are connected together in the foregoing order by refrigerant pipes. In the refrigerant circuit (21) of the target apparatus (20), a liquid-side service port (21*a*) of a liquid pipe and a gas-side service port (21*b*) of a gas pipe are connected to the inlet (36) of the refrigerant recovery apparatus (30A) through a gauge manifold (90).

The refrigerant recovery container (100) includes a container body (101), a liquid inflow port (103) provided with a liquid inflow valve (103*a*), a gas outflow port (102) provided with a gas outflow valve (102*a*), and a float sensor (105). The outlet (37) of the refrigerant recovery apparatus (30A) is connected to the liquid inflow port (103) of the refrigerant recovery container (100). Although not shown, an upper surface of the refrigerant recovery container (100) or the gas outflow port (102) is provided with a fusible plug, which functions as an air vent while the container body (101) has an abnormally high internal pressure. The float sensor (105) determines the upper limit of the liquid level, thereby substantially preventing liquid sealing of the refrigerant recovery container (100).

The refrigerant recovery apparatus (30A) includes a high pressure shut-off switch (83) disposed on the discharge side of the compressor (31) to stop the compressor (31) if the pressure of the refrigerant discharged from the compressor (31) is equal to or higher than a predetermined value. A set value of the high pressure shut-off switch (83) is often set to be a lower value, generally about 3 MPa. The reason for this is that the refrigerant recovery apparatus (30A) is used to recover various refrigerants, and the set value of the high pressure shut-off switch (83) is thus adapted to a refrigerant circulating through a refrigeration cycle whose high pressure is designed to be relatively low so that, if any type of refrigerant is recovered, the pressure of the refrigerant recovery container (100) does not rise excessively.

To recover a refrigerant, the refrigerant in the target apparatus (20) is sucked by the compressor (31) of the refrigerant recovery apparatus (30A), for example, in a liquid/gas mixed state or a gaseous state. The sucked refrigerant is compressed by the compressor (31). The compressed refrigerant is condensed by exchanging heat with air in the condenser (32), and turns into a liquid refrigerant. Then, the liquid refrigerant is sent from the outlet (37) to the refrigerant recovery container (100), and is accumulated in the refrigerant recovery container (100).

The recovery of the refrigerant allows the liquid refrigerant to enter a portion of the refrigerant recovery container (100) in which a gas refrigerant is accumulated. This increases the internal pressure of the refrigerant recovery container (100).

On the other hand, as described above, the set value of the high pressure shut-off switch (83) is generally relatively low. The saturation pressure of a refrigerant R410A or R32 for use as a refrigerant for a recent air conditioner or refrigerator at a temperature of about 50° C., for example, corresponds to 3 MPa. For example, under a high-temperature condition where a refrigerant is recovered at an ambient temperature of 35° C. or higher, the condensation temperature of the gas refrigerant is about 15° C. higher than the air suction temperature (35° C.). Thus, only recovering a refrigerant for a relatively short period increases the refrigerant pressure (temperature) to 3 MPa (about 50° C.). As a result, the high pressure shut-off switch (83) operates to stop the compressor (31), and the refrigerant recovery apparatus (30A) immediately stops.

To address the problem in which the refrigerant pressure increases to stop the refrigerant recovery apparatus (30A) in a relatively short time as described above, the refrigerant recovery container (100) may be cooled with water continuously poured thereon while being covered with a wet waste cloth, at a worksite where a refrigerant recovery operation is performed.

However, if such a countermeasure is taken, water having a low temperature needs to be prepared, and in the summer season, ice may be required. For this reason, an operator needs to make efforts to prepare water and ice and to place the water and ice into an insulated container to carry the water and ice to the worksite, before the refrigerant recovery operation. This need increases the number of operation steps and the cost. In addition, if a refrigerant is recovered from a plurality of target apparatuses (20) within one day, a complicated operation is also required to add water or ice during the operation.

Patent Document 1: Japanese Unexamined Patent Publication No. 2005-344988

SUMMARY

On the other hand, just like a system (6) shown in FIG. 7, a cooling coil (a water cooled condenser) (47) may be provided, as an auxiliary heat exchanger, on a refrigerant recovery hose (80) between an outlet (37) of a refrigerant recovery apparatus (30B) and a refrigerant recovery container (100), and may be immersed in water to cool a refrigerant, thereby preventing the refrigerant pressure from rising too much. Using the cooling coil (47) as described above can reduce the operator's efforts to pour water on the refrigerant recovery container and to carry water and ice.

However, if a countermeasure in which the cooling coil (47) is used is taken, a refrigerant remains in the cooling coil (47) at the timing when the refrigerant recovery apparatus (30B) is stopped. This causes the refrigerant to be insufficiently recovered into the refrigerant recovery container (100), resulting in a reduction in the recovery efficiency of the refrigerant. To recover the refrigerant accumulated in the cooling coil as well to solve this problem, an operation needs to be separately performed to recover the refrigerant from the cooling coil after stopping the refrigerant recovery apparatus. This reduces the operation efficiency.

It is an object of the present disclosure to reduce the degrees to which the recovery efficiency of a refrigerant and the operation efficiency decrease if a refrigerant recovery apparatus is connected to an auxiliary heat exchanger, such as a cooling coil, to recover the refrigerant.

A first aspect of the present disclosure is based on a refrigerant recovery apparatus connected between a target apparatus (20) from which a refrigerant is recovered and a refrigerant recovery container (100).

The apparatus includes: a compressor (31) configured to suck the refrigerant from a refrigerant circuit (21) of the target apparatus (20) through a refrigerant suction path (75) and compress the refrigerant; a condenser (32) configured to condense the refrigerant discharged from the compressor (31) and send the refrigerant to the refrigerant recovery container (100) through a main refrigerant recovery path (70); and a residual refrigerant recovery path (77) through which a decompression mechanism (41) on a branch path (76) branching from the main refrigerant recovery path (70) decompresses a residual refrigerant in the condenser (32), the decompressed refrigerant is sucked into the compressor (31) and pressurized, and the pressurized refrigerant is sent into the refrigerant recovery container (100). Auxiliary heat exchanger connection ports (48*a*, 48*b*) that can be connected to an auxiliary heat exchanger (47) configured to cool a refrigerant are provided near an outlet of the condenser (32) and upstream of a junction between the main refrigerant path (70) and the branch path (76).

A second aspect of the present disclosure is based on a refrigerant recovery apparatus connected between a target apparatus (20) from which a refrigerant is recovered and a refrigerant recovery container (100), just like the first aspect.

The apparatus includes: a compressor (31) configured to suck the refrigerant from a refrigerant circuit (21) of the target apparatus (20) through a refrigerant suction path (75) and compress the refrigerant; a condenser (32) configured to condense the refrigerant discharged from the compressor (31) and send the refrigerant to the refrigerant recovery container (100) through a main refrigerant recovery path (70); and a residual refrigerant recovery path (77) through which a decompression mechanism (41) on a branch path (76) branching from the main refrigerant recovery path (70) decompresses a residual refrigerant in the condenser (32), the decompressed refrigerant is sucked into the compressor (31) and pressurized, and the pressurized refrigerant is sent into the refrigerant recovery container (100). An auxiliary heat exchanger (47) configured to cool a refrigerant is connected near an outlet of the condenser (32) and upstream of a junction between the main refrigerant path (70) and the branch path (76).

In the first and second aspects, operating the compressor (31) of the refrigerant recovery apparatus allows a refrigerant to be sucked into the compressor (31) from the refrigerant circuit (21) of the refrigerant recovery apparatus (20) and to be compressed. The refrigerant discharged from the compressor (31) is condensed and liquefied in the condenser (32), and is recovered into the refrigerant recovery container (100). Since the auxiliary heat exchanger (47) configured to cool the refrigerant is connected to the outlet side of the condenser (32), cooling of the refrigerant recovered from the condenser (32) into the refrigerant recovery container (100) is accelerated. This reduces an increase in the refrigerant pressure in the refrigerant recovery container (100).

When the refrigerant remaining in the condenser (32) is recovered into the refrigerant recovery container (100), the refrigerant remaining in the condenser (32) and the auxiliary heat exchanger (47) passes through the branch path (76), and is decompressed by the decompression mechanism (41). The decompressed refrigerant is pressurized by the compressor (31), and is sent to the refrigerant recovery container (100). The recovery of the residual refrigerant is generally called self-cleaning in the refrigerant recovery using a known refrigerant recovery apparatus. However, in the first and second aspects, this self-cleaning further enables recovery of the residual refrigerant in the auxiliary heat exchanger (47).

A third aspect of the present disclosure is an embodiment of the first or second aspect. In the third aspect, the auxiliary heat exchanger (47) is configured as a water cooled condenser (47).

In this third aspect, the refrigerant near the outlet of the condenser (32) is further cooled by the water cooled condenser (47), thereby reducing an increase in the refrigerant pressure in the refrigerant recovery container (100).

According to the first through third aspects of the present disclosure, using the auxiliary heat exchanger (47) can reduce the refrigerant remaining in the auxiliary heat exchanger (47) after refrigerant recovery. Consequently, the efficiency of the refrigerant recovered does not decrease significantly. Since the refrigerant in the auxiliary heat exchanger (47) does not have to be separately recovered, the operation efficiency of refrigerant recovery does not decrease significantly. Further, it is possible to use the auxiliary heat exchanger (47), such as a cooling coil similar to that in the known art, thereby easily reducing the degrees to which the recovery efficiency of a refrigerant and the operation efficiency decrease.

DETAILED DESCRIPTION OF EMBODIMENT(S)

An embodiment will now be described in detail with reference to the drawings.

Figure 1:
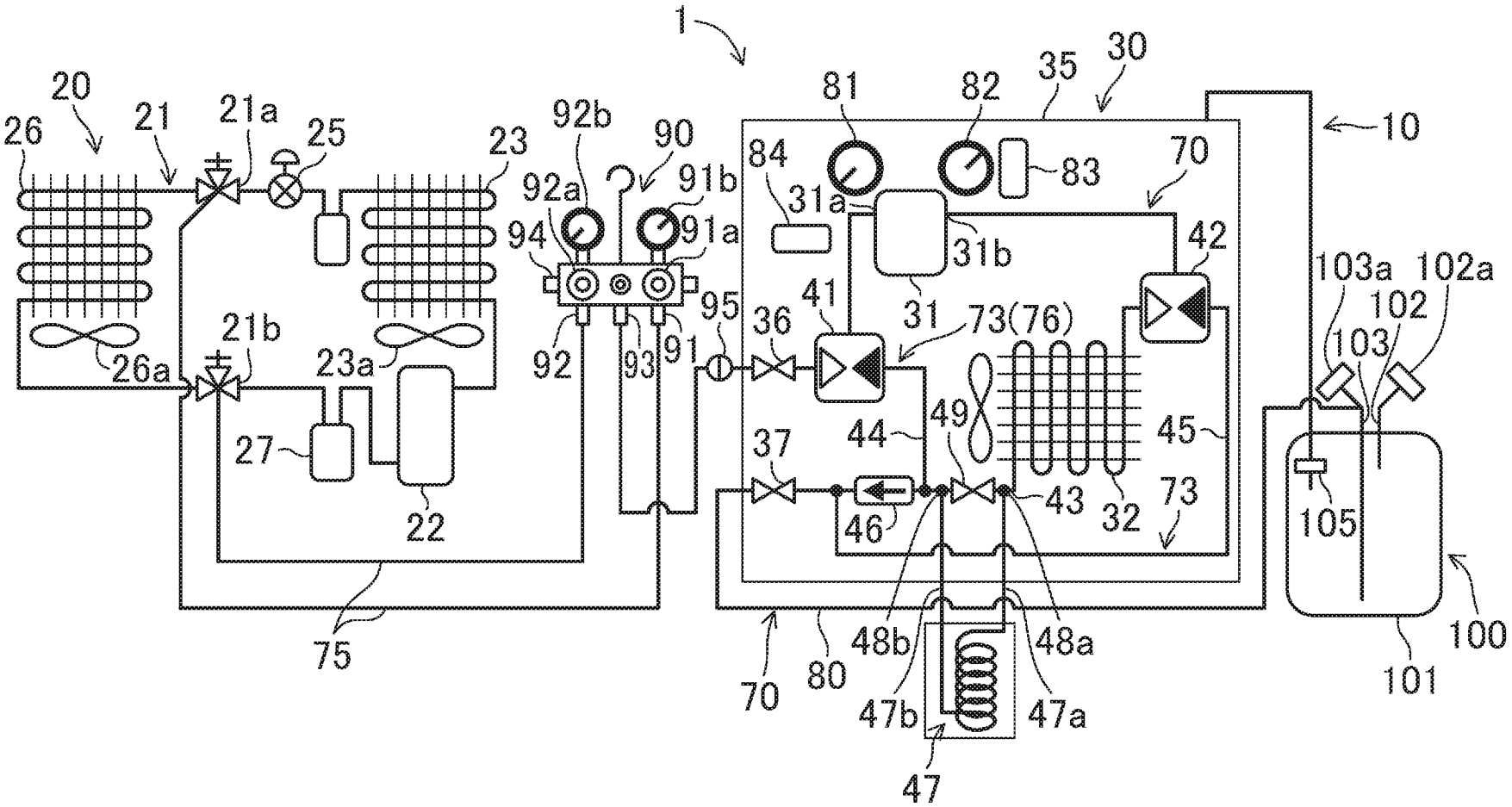
FIG. 1 is a circuit diagram showing a refrigerant recovery system according to an embodiment.

FIG. 1 shows the overall configuration of a refrigerant recovery system (1) according to this embodiment. The refrigerant recovery system (1) uses a refrigerant recovery container-equipped recovery apparatus (10) including a refrigerant recovery container (100) connected to a refrigerant recovery apparatus (30) to recover a refrigerant into the refrigerant recovery container (100) from a target apparatus (20) from which the refrigerant is recovered.

〈Target Apparatus〉

The target apparatus (20) is an apparatus, such as an air conditioner or a refrigerator, including a refrigerant circuit (21). The refrigerant circuit (21) of the target apparatus (20) includes a compressor (22), a heat-source-side heat exchanger (23), a liquid receiver (24), an expansion mechanism (25), a utilization-side heat exchanger (26), and an accumulator (27), and is a closed circuit in which these components are connected together in the foregoing order. The refrigerant circuit (21) is filled with, for example, a refrigerant R32. The refrigerant circuit (21) has a liquid-side service port (21*a*) and a gas-side service port (21*b*). A heat-source-side fan (23*a*) is disposed near the heat-source-side heat exchanger (23). A utilization-side fan (26*a*) is disposed near the utilization-side heat exchanger (26).

〈Refrigerant Recovery Container-Equipped Recovery Apparatus〉

As described above, the refrigerant recovery container-equipped recovery apparatus (10) according to this embodiment includes the refrigerant recovery apparatus (30) and the refrigerant recovery container (100). The refrigerant recovery apparatus (30) is connected between the target apparatus (20) and the refrigerant recovery container (100).

〈Refrigerant Recovery Apparatus〉

The refrigerant recovery apparatus (30) of this embodiment includes a compressor (31) and a condenser (32). The compressor (31) sucks a refrigerant from the refrigerant circuit (21) of the target apparatus (20), and compresses the sucked refrigerant. The condenser (32) condenses the refrigerant discharged from the compressor (31) to send the condensed refrigerant to the refrigerant recovery container (100).

The refrigerant recovery apparatus (30) is specifically configured as follows.

First, the refrigerant recovery apparatus (30) further includes a casing (35) in which components, such as the compressor (31) and the condenser (32), are housed. The casing (35) has an inlet (36) connected through a gauge manifold (90) to the target apparatus (20), and an outlet (37) connected through a refrigerant recovery hose (80) to a liquid inflow port (103), described below, of the refrigerant recovery container (100).

A gas-side switching valve (41) serving as a decompression mechanism that decompresses the refrigerant through narrowing of a passage is connected between the inlet (36) and a suction port (31*a*) of the compressor (31), and a liquid-side switching valve (42) is connected between a discharge port (31*b*) of the compressor (31) and the condenser (32). The gas-side switching valve (41) and the liquid-side switching valve (42) are both three-way valves, which are connected together with first and second refrigerant recovery pipes (44) and (45) interposed between their respective black filled closed ports shown in FIG. 1 and an outlet pipe (43) of the condenser (32). A check valve (46) is provided between a first connection point at which the first refrigerant recovery pipe (44) and the outlet pipe (43) are connected together and a second connection point at which the second refrigerant recovery pipe (45) and the outlet pipe (43) are connected together. The check valve (46) allows the refrigerant to flow from the first connection point to the second connection point, and prevents the refrigerant from flowing in a reverse direction. The first refrigerant recovery pipe (44) defines a branch path (76), which will be described below.

The gas-side switching valve (41) and the liquid-side switching valve (42) are switching valves capable of selecting one of channels and controlling the flow rate. The refrigerant recovery apparatus (30) includes one controller (not shown) controlling the gas-side switching valve (41) and the liquid-side switching valve (42). The controller can be configured as, for example, a dial knob. Rotating the dial knob from a reference position in one direction (for example, in a clockwise direction) allows a gas refrigerant (gas) to be recovered from the target apparatus (20), and can gradually reduce the gas flow rate. Rotating the controller in a reverse direction (for example, in a counterclockwise direction) allows a liquid refrigerant (liquid) to be recovered from the target apparatus (20), and can gradually reduce the liquid flow rate. During the liquid recovery; the amount of the flow rate reduced is larger than that during the gas recovery. Further, the controller is configured to enable an operation of narrowing the gas-side switching valve (41) when a residual refrigerant recovery operation (self-cleaning) is performed to recover a residual refrigerant remaining in the condenser (32).

The refrigerant recovery apparatus (30) includes a suction pressure gauge (81) and a discharge pressure gauge (82). A high pressure shut-off switch (83) is provided on the discharge side of the compressor (31), and a low pressure shut-off switch (84) is provided on the suction side of the compressor (31). The high pressure shut-off switch (83) stops the compressor (31) to prevent the discharge pressure of the compressor (31) from rising excessively, if the discharge pressure reaches a set high pressure. This set high pressure is determined based on, for example, an allowable pressure of the refrigerant recovery container (100), and is often determined based on the design pressure of a refrigerant circuit containing a refrigerant with a relatively low saturation pressure. The low pressure shut-off switch (84) stops the compressor (31) to prevent the suction pressure of the compressor (31) from dropping excessively if the suction pressure reaches a set low pressure. The low pressure shut-off switch (84) includes the controller selecting one of its "active" and "inactive" states and provided in the refrigerant recovery apparatus (30). The low pressure shut-off switch (84) is basically brought into the "active" state during refrigerant recovery to automatically end a refrigerant recovery operation. However, when the low pressure drops transitionally, such as at the start of the refrigerant recovery operation, the low pressure shut-off switch (84) may be brought into the "inactive" state to prevent the refrigerant recovery apparatus (30) from stopping.

The outlet pipe (43) connected to the condenser (32) has auxiliary heat exchanger connection ports (48*a*, 48*b*) that can be connected to an auxiliary heat exchanger (47) for cooling a refrigerant and which are provided upstream of the junction between a main refrigerant path (70) and the branch path (76) both described below. The auxiliary heat exchanger connection ports (48*a*, 48*b*) are configured as an inlet-side connection port (48*a*) and an outlet-side connection port (48*b*), respectively. The outlet pipe (43) is provided with an open/close valve (49) between the inlet-side connection port (48*a*) and the outlet-side connection port (48*b*).

The auxiliary heat exchanger (47) is, for example, a water cooled condenser including a cooling coil housed in a cylindrical container having an opening through which water flows, and includes a refrigerant inflow pipe (47*a*) and a refrigerant outflow pipe (47*b*). The refrigerant inflow pipe (47*a*) is connected to the inlet-side connection port (48*a*), and the refrigerant outflow pipe (47*b*) is connected to the outlet-side connection port (48*b*). The auxiliary heat exchanger (47) is used while being immersed in water inside a reservoir in which water is stored, and cools the refrigerant flowing through the cooling coil. If the temperature of the water in the reservoir rises during the use of the auxiliary heat exchanger (47), water merely needs to be changed.

〈Refrigerant Recovery Path〉

The refrigerant recovery system (1) of this embodiment includes components connected together through a refrigerant suction path (75), the main refrigerant recovery path (70), and a residual refrigerant recovery path (73).

The refrigerant suction path (75) is formed by connecting the gauge manifold (90) between the target apparatus (20) and the inlet (36).

The main refrigerant recovery path (70) is a path from the inlet (36) to the refrigerant recovery container (100) through the gas-side switching valve (41), the compressor (31), the liquid-side switching valve (42), the condenser (32), the auxiliary heat exchanger (47), the check valve (46), and the outlet (37).

Figure 3:
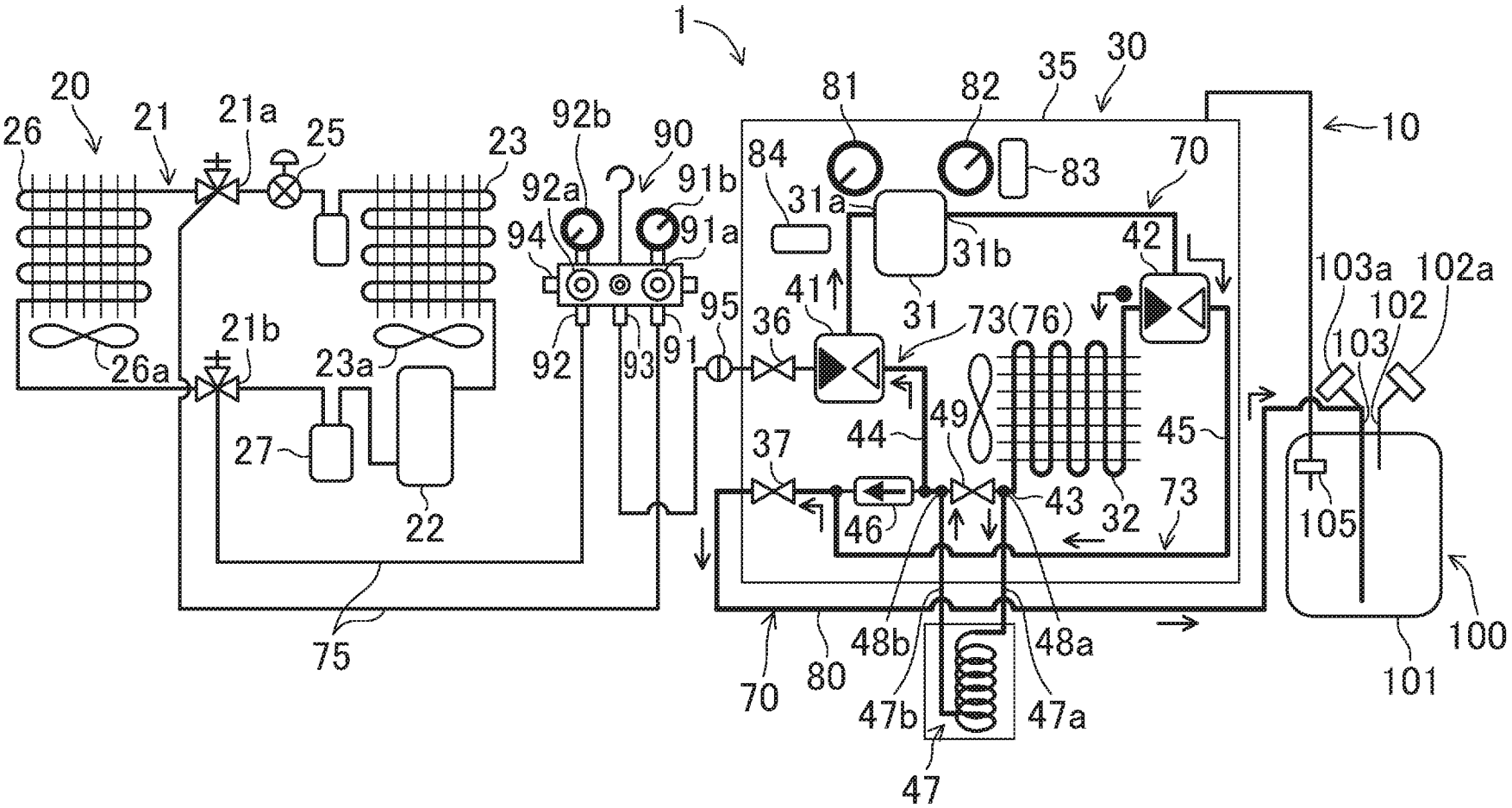
FIG. 3 is an operation state diagram showing a second refrigerant recovery step in the refrigerant recovery system shown in FIG. 1.

The residual refrigerant recovery path (73) is formed in the state shown in FIG. 3 in which the inflow side of the condenser (32) is closed by the liquid-side switching valve (42), and leads to the refrigerant recovery container (100) through the condenser (32), the auxiliary heat exchanger (47), the branch path (76), the gas-side switching valve (41), the compressor (31), the liquid-side switching valve (42), and the outlet (37).

〈Refrigerant Recovery Container〉

The refrigerant recovery container (100) includes a container body (101) in which a refrigerant is stored. The container body (101) has a gas outflow port (102) through which a gas refrigerant can flow out of the container body (101), and a liquid inflow port (103) through which a liquid refrigerant sent from the condenser (32) of the refrigerant recovery apparatus (30) is introduced into the container body (101). The gas outflow port (102) and the liquid inflow port (103) are provided with a gas outflow valve (102*a*) and a liquid inflow valve (103*a*), respectively. The gas outflow valve (102*a*) and the liquid inflow valve (103*a*) open and close the associated ports (102, 103).

The refrigerant recovery container (100) includes a float sensor (105) functioning to allow the refrigerant recovery apparatus (30) to recognize the liquid level of the liquid refrigerant stored in the container body (101). If a float of the float sensor (105) reaches a predetermined height, a determination is made that the amount of the liquid refrigerant stored has reached a specified amount, and the refrigerant recovery apparatus (30) thus stops.

Although not shown, an upper surface of the container body (101) or the gas outflow port (102) is provided with a fusible plug (not shown). The fusible plug is provided as an air vent which functions to prevent the internal pressure of the refrigerant recovery container (100) from increasing excessively when the recovery container (100) has its ambient temperature increased.

〈Gauge Manifold〉

The gauge manifold (90) is equipped with a pressure gauge that has been commonly used, and includes a high pressure valve-side port (91), a low pressure valve-side port (92), a vacuum pump-side port (93), and an air purge port (94).

The high pressure valve-side port (91) of the gauge manifold (90) is connected to the liquid-side service port (21*a*) of the target apparatus (20). The low pressure valve-side port (92) of the gauge manifold (90) is connected to the gas-side service port (21*b*) of the target apparatus (20). The vacuum pump-side port (93) of the gauge manifold (90) is connected to the inlet (36) of the refrigerant recovery apparatus (30) through a filter (95). The gauge manifold (90) further has the air purge port (94), which is not used in this embodiment.

While a gas is recovered, a low pressure-side valve (gas valve) (92*a*) of the gauge manifold (90) is opened. If a liquid and a gas are simultaneously recovered, both a high pressure-side valve (liquid valve) (91*a*) and the low pressure-side valve (92*a*) are opened. The gauge manifold (90) includes a low pressure gauge (92*b*) and a high pressure gauge (91*b*).

Operation

Next, a refrigerant recovery method will be described. In this method, a refrigerant is sucked into the compressor (31) of the refrigerant recovery apparatus (30) from the refrigerant circuit (21) of the target apparatus (20), and is compressed. The resultant refrigerant condensed in the condenser (32) of the refrigerant recovery apparatus (30) is sent to the refrigerant recovery, container (100), thereby recovering the refrigerant in the refrigerant recovery container (100).

In this embodiment, after preparation for operation, first and second refrigerant recovery steps described below are sequentially performed. In the first refrigerant recovery step, a refrigerant is sucked from the target apparatus (20) into the compressor (31) of the refrigerant recovery apparatus (30) in a liquid/gas mixed state or a gaseous state.

In the stage of operation preparation, the liquid valve (91*a*) and gas valve (92*a*) of the gauge manifold (90) are each switched to its "open" state. Two of ports of the gas-side switching valve (41) of the refrigerant recovery apparatus (30) near the inlet (36) and the compressor (31) communicate with each other, and the other port thereof near the branch path (76) is closed. The opened port is hollow, and the closed port is filled. This also applies to the following description. Two of ports of the liquid-side switching valve (42) near the compressor (31) and the condenser (32) communicate with each other, and the other port thereof near the residual refrigerant recovery path (73) is closed. The gas-side switching valve (41) is set to have an opening degree low enough to prevent a refrigerant from being rapidly recovered from the target apparatus (20) to the compressor (31) during operation. The open/close valve (49) is basically in a "closed" state. However, while the auxiliary heat exchanger (47) is not in use, the open/close valve (49) is set to be in the "open" state. The gas outflow valve (102*a*) and liquid inflow valve (103*a*) of the refrigerant recovery container (100) are both opened. In preparation for operation, it is recommended that a liquid refrigerant be heated in the target apparatus (20) to accelerate evaporation of the liquid refrigerant.

〈First Refrigerant Recovery Step〉

Figure 2:
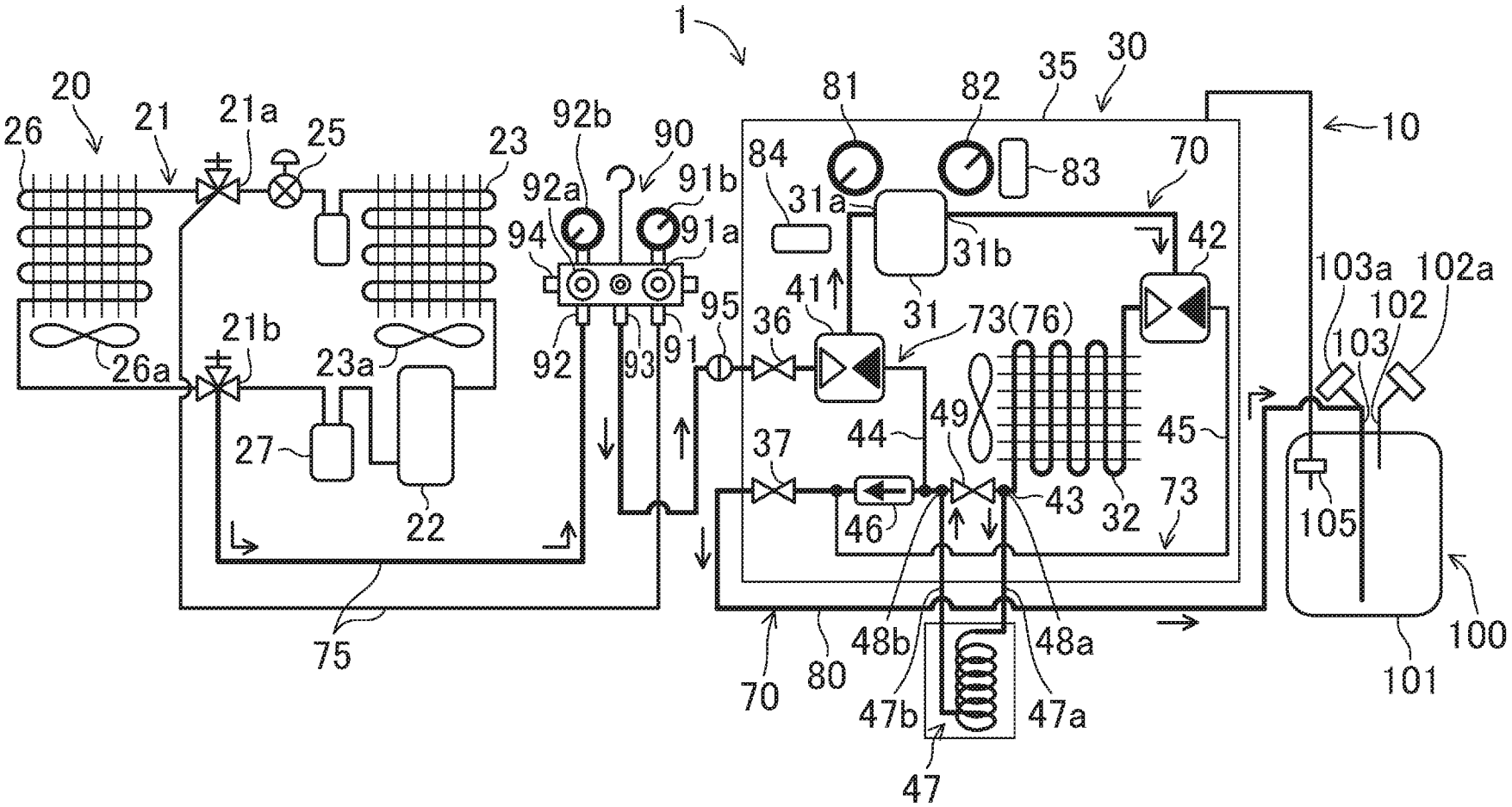
FIG. 2 is an operation state diagram showing a first refrigerant recovery step in the refrigerant recovery system shown in FIG. 1.

As shown in FIG. 2, in the first refrigerant recovery step, a refrigerant is sucked from the target apparatus (20) through the refrigerant suction path (75) into the compressor (31) of the refrigerant recovery apparatus (30), then passes through the compressor (31) and the condenser (32), and is recovered from the liquid inflow port (103) of the refrigerant recovery container (100) into the container body (101) of the refrigerant recovery container (100).

In the first refrigerant recovery step, the refrigerant is sucked from the target apparatus (20) into the compressor (31) through the gauge manifold (90), and the refrigerant discharged from the compressor (31) is condensed in the condenser (32), and then flows into the refrigerant recovery container (100). This increases the amount of the refrigerant stored in the refrigerant recovery container (100).

At this time, the refrigerant that has flowed out of the condenser (32) is cooled by the auxiliary heat exchanger (47). This allows the refrigerant to be more effectively cooled, and reduces an increase in the internal pressure of the refrigerant recovery container (100).

If most of the refrigerant in the target apparatus (20) is recovered, the pressures indicated by the low pressure gauge (92*b*) and high pressure gauge (91*b*) of the gauge manifold (92) and the suction pressure gauge (81) and discharge pressure gauge (82) of the refrigerant recovery apparatus (30) reach respective predetermined values. Then, the compressor (31) stops temporarily, and the first refrigerant recovery step is completed.

〈Second Refrigerant Recovery Step〉

Immediately after completion of the first refrigerant recovery step, the refrigerant remains in the condenser (32) of the refrigerant recovery apparatus (30). Thus, a second refrigerant recovery step is subsequently performed to recover the residual refrigerant in the condenser (32).

The second refrigerant recovery step is performed to recover the refrigerant from the condenser (32) through the compressor (31) into the refrigerant recovery container (100). When the second refrigerant recovery step is to be started, one of the ports of the gas-side switching valve (41) of the refrigerant recovery apparatus (30) near the inlet (36) is closed, and the other ports near the compressor (31) and the branch path (76) communicate with each other. Two of the ports of the liquid-side switching valve (42) near the compressor (31) and the residual refrigerant recovery path (73) communicate with each other, and the other port thereof near the condenser (32) is closed.

Specifically, in the second refrigerant recovery step, a refrigerant recovery operation (self-cleaning) shown in FIG. 3 is performed. In this operation, the compressor (31) is restarted after the completion of the first refrigerant recovery step, and while the gas outflow port (102) is closed, the refrigerant remaining in the condenser (32) is sucked by the compressor (31) and then sent into the refrigerant recovery container (100). In the refrigerant recovery operation shown in FIG. 3, while the port of the liquid-side switching valve (42) near the condenser (32) is closed, and the ports of the gas-side switching valve (41) near the branch path (76) and the compressor (31) communicate with each other, the compressor (31) is operated. At this time, the gas-side switching valve (41) is narrowed until the suction pressure gauge (81) indicates a low pressure substantially close to the vacuum. The residual refrigerant is sucked from the condenser (32) into the compressor (31), and is pressurized. The pressurized refrigerant is recovered through the liquid-side switching valve (42) and the residual refrigerant recovery path (73) into the refrigerant recovery container (100).

During the operation shown in FIG. 3, if the suction pressure becomes lower than a predetermined value and becomes substantially vacuum, the compressor (31) stops. Thereafter, the gas-side switching valve (41) and the liquid-side switching valve (42) are closed, the liquid inflow port (103) of the refrigerant recovery container (100) is closed, and a refrigerant recovery hose (80) is then detached from the apparatus (10). Thus, the refrigerant recovery steps are all completed.

In this embodiment, performing the second refrigerant recovery step allows the refrigerant in the auxiliary heat exchanger (47) to also pass from the compressor (31) through the residual refrigerant recovery path (73) and to be recovered into the refrigerant recovery container (100). That is to say, using the feature of this embodiment enables efficient recovery of the entire refrigerant in the target apparatus (20) without the need for separately recovering the refrigerant from the auxiliary heat exchanger (47).

Advantages of Embodiment

According to this embodiment, using the auxiliary heat exchanger (47) can reduce the refrigerant remaining in the auxiliary heat exchanger (47) after refrigerant recovery. Consequently, the efficiency of the refrigerant recovered does not decrease significantly. Since the refrigerant in the auxiliary heat exchanger (47) does not have to be separately recovered, the operation efficiency of refrigerant recovery does not decrease significantly. Further, since the auxiliary heat exchanger (47), such as a cooling coil similar to that in the known art, can be used, thereby easily reducing the degrees to which the recovery efficiency of a refrigerant and the operation efficiency decrease.

Variations of Embodiment

〈First Variation〉

In the embodiment shown in FIGS. 1 to 3, the outlet pipe (43) connected to the condenser (32) has the auxiliary heat exchanger connection ports (48*a*, 48*b*) which can be connected to the auxiliary heat exchanger (47) for cooling a refrigerant and which are provided upstream of the junction between the main refrigerant path (70) and the branch path (76). These auxiliary heat exchanger connection ports (48*a*, 48*b*) are connected to the auxiliary heat exchanger (47) separate from the refrigerant recovery apparatus (10). However, the outlet pipe (43) connected to the condenser (32) may have a portion located upstream of the junction between the main refrigerant path (70) and the branch path (76) and directly connected to the auxiliary heat exchanger (47), and the auxiliary heat exchanger (47) may be integrated with the refrigerant recovery apparatus (30).

Even with such a configuration, an advantage similar to that in the embodiment shown in FIG. 1 can be achieved.

〈 Second Variation 〉

Figure 4:
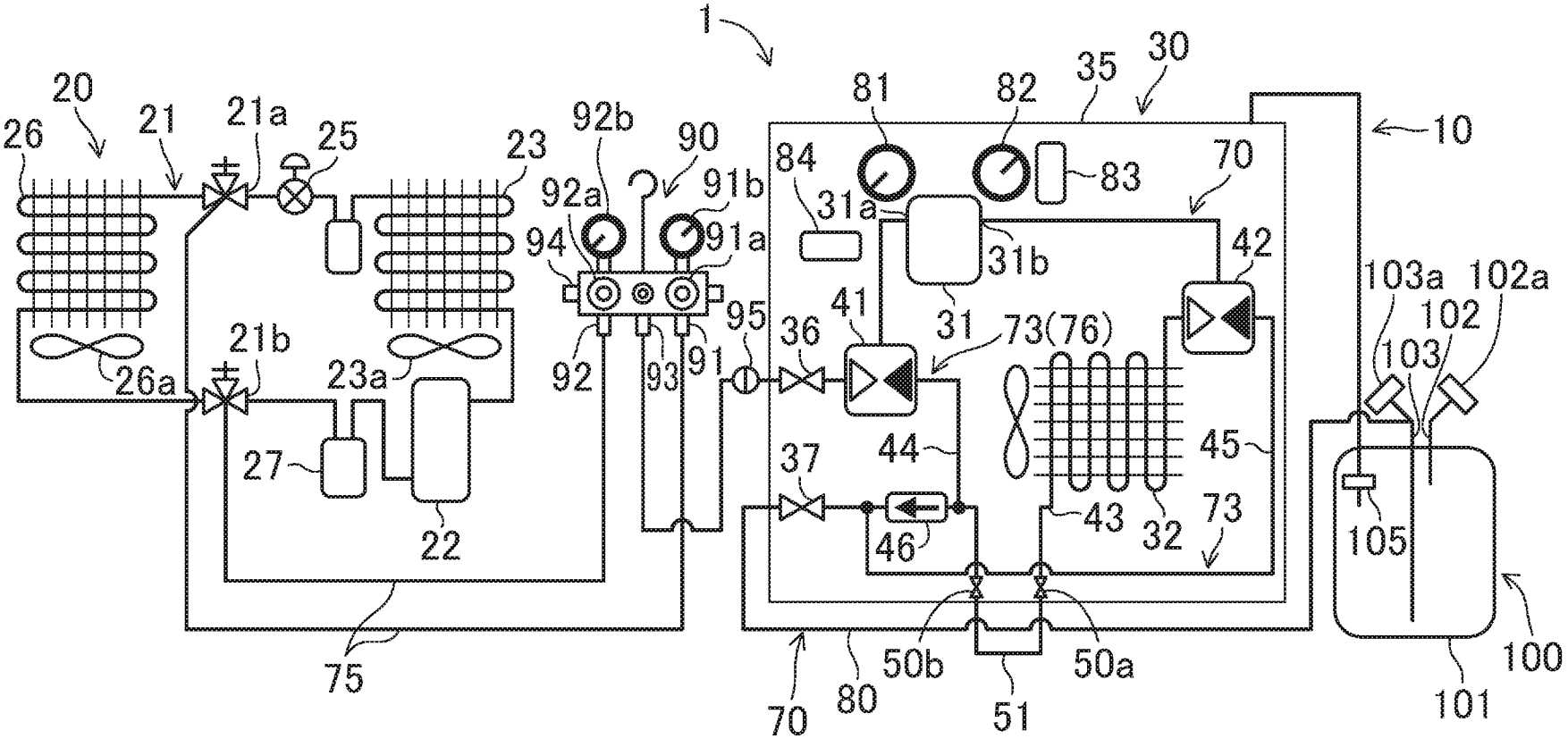
FIG. 4 is a circuit diagram showing a refrigerant recovery system according to a second variation of the embodiment, and shows the refrigerant recovery system from which an auxiliary heat exchanger is detached.
Figure 5:
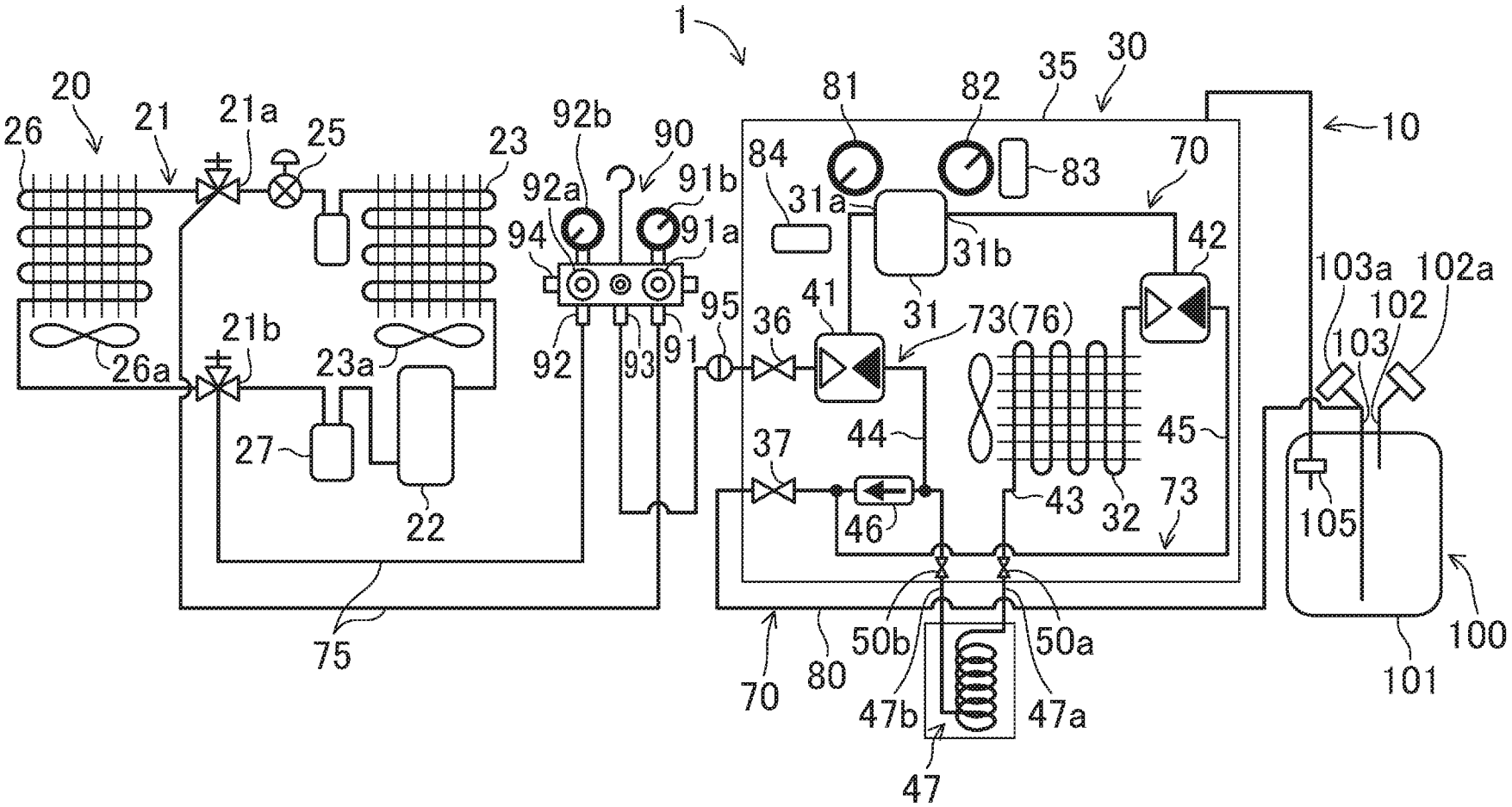
FIG. 5 is a circuit diagram showing the refrigerant recovery system according to the second variation of the embodiment, and shows the refrigerant recovery system to which the auxiliary heat exchanger is attached.
Figure 6:
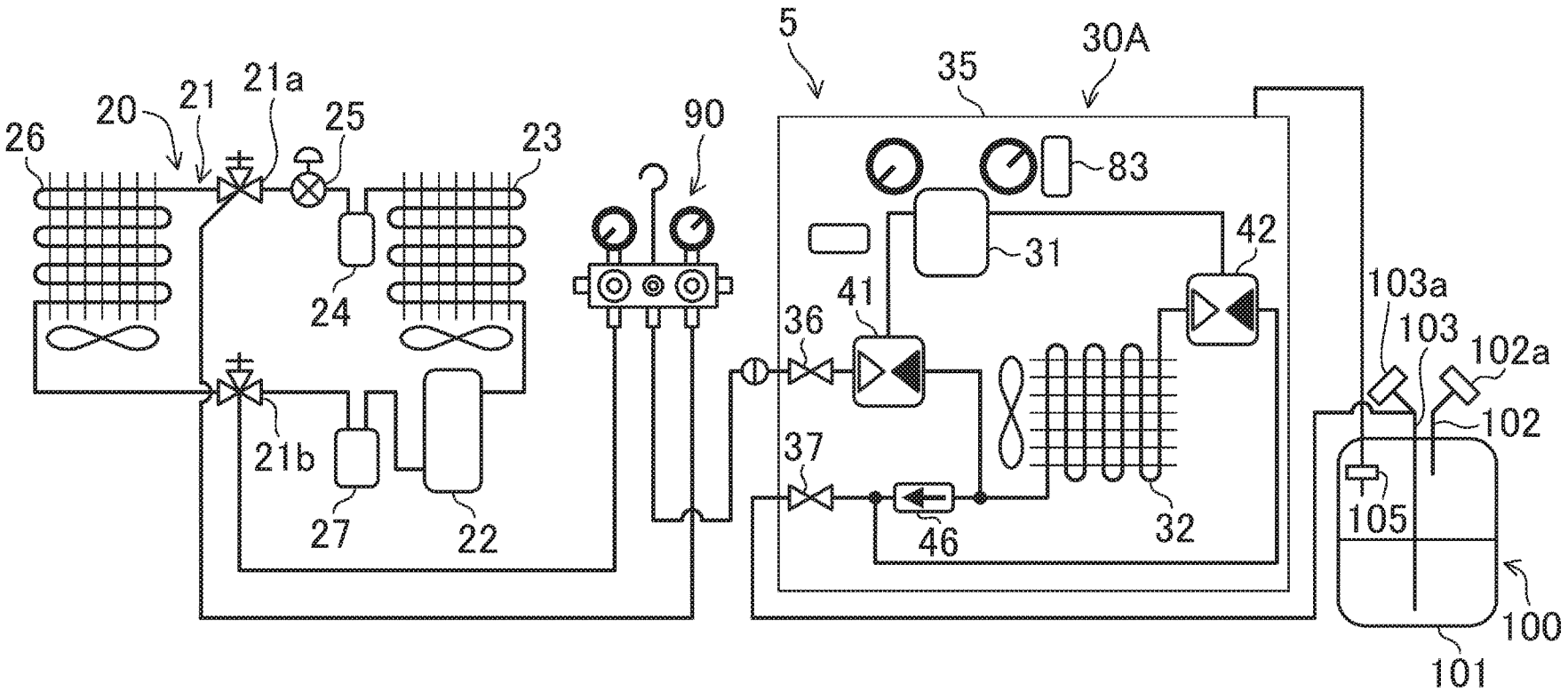
FIG. 6 is a circuit diagram showing a refrigerant recovery system according to a first known example.
Figure 7:
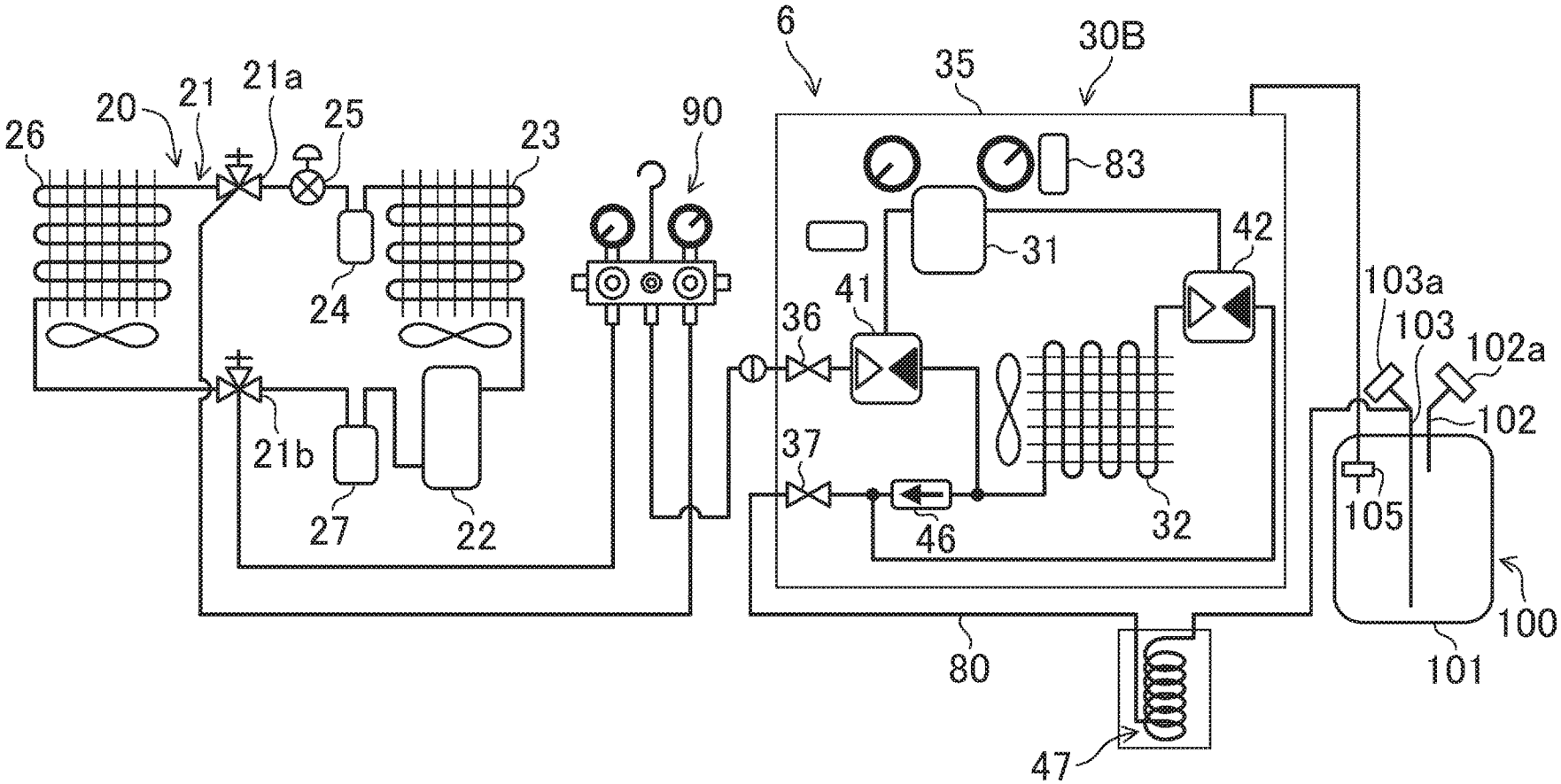
FIG. 7 is a circuit diagram showing a refrigerant recovery system according to a second known example.

The auxiliary heat exchanger (47) may be attached to, and detached from, the refrigerant recovery apparatus (30) through the outlet pipe (43) connected to the condenser (32) and configured as in a second variation shown in FIGS. 4 and 5. FIG. 4 shows a state in which the auxiliary heat exchanger (47) is detached from the refrigerant recovery apparatus (30), and FIG. 5 shows a state in which the auxiliary heat exchanger (47) is attached to the refrigerant recovery apparatus (30).

In the second variation, the outlet pipe (43) connected to the condenser (32) has two connection fittings (50*a*, 50*b*). In the state shown in FIG. 4 in which the auxiliary heat exchanger (47) is not used during refrigerant recovery, a connection pipe (51) is attached between the two connection fittings (50*a*, 50*b*). On the other hand, when the auxiliary heat exchanger (47) is used during refrigerant recovery, the connection pipe (51) shown in FIG. 4 is detached from the connection fittings (50*a*, 50*b*), and the refrigerant inflow pipe (47*a*) and refrigerant outflow pipe (47*b*) of the auxiliary heat exchanger (47) are attached to the connection fittings (50*a*, 50*b*), respectively.

Even with such a configuration, the auxiliary heat exchanger (47) can be easily attached to the refrigerant recovery apparatus (30). If the refrigerant is recovered using the auxiliary heat exchanger (47), the recovery efficiency of the refrigerant and the operation efficiency do not decrease significantly just like the embodiment shown in FIGS. 1 to 3.

〈〈 Other Embodiments 〉〉

The foregoing embodiment may be modified as follows.

For example, the refrigerant recovery apparatus (30) according to the present disclosure is suitable for preventing the pressure of the refrigerant recovery container (100) into which a refrigerant circulating through a refrigeration cycle whose high pressure is designed to be relatively high, such as a refrigerant R410A as well as the refrigerant R32 described in the foregoing embodiment, is recovered from rising too much. However, a refrigerant in a target apparatus used should not be limited to these refrigerants.

Note that the foregoing description of the embodiments is a merely preferred example in nature, and is not intended to limit the scope, application, or uses of the present disclosure.

As can be seen from the foregoing description, the present disclosure is useful for a refrigerant recovery apparatus for sucking a refrigerant from a refrigerant circuit of a target apparatus from which the refrigerant is recovered, such as a refrigerator or an air conditioner, liquefying the refrigerant, and discharging the refrigerant to a refrigerant recovery container.

What is claimed is:

1. A refrigerant recovery apparatus connected between a target apparatus from which a refrigerant is recovered and a refrigerant recovery container, the apparatus comprising:

a compressor configured to suck the refrigerant from a refrigerant circuit of the target apparatus through a refrigerant suction path and compress the refrigerant;

a condenser configured to condense the refrigerant discharged from the compressor and send the refrigerant to the refrigerant recovery container through a main refrigerant recovery path; and a residual refrigerant recovery path through which a decompression mechanism on a branch path branching from the main refrigerant recovery path decompressing a residual refrigerant in the condenser, the decompressed refrigerant being sucked into the compressor and pressurized, and the pressurized refrigerant being sent into the refrigerant recovery container, auxiliary heat exchanger connection ports being connectable to an auxiliary heat exchanger configured to cool a refrigerant, the auxiliary heat exchanger connection ports being provided near an outlet of the condenser and upstream of a junction between the main refrigerant recovery path and the branch path.

2. The apparatus of claim 1, wherein the auxiliary heat exchanger is configured as a water cooled condenser.

3. A refrigerant recovery apparatus connected between a target apparatus from which a refrigerant is recovered and a refrigerant recovery container, the apparatus comprising:

a compressor configured to suck the refrigerant from a refrigerant circuit of the target apparatus through a refrigerant suction path and compress the refrigerant;

a condenser configured to condense the refrigerant discharged from the compressor and send the refrigerant to the refrigerant recovery container through a main refrigerant recovery path; and a residual refrigerant recovery path through which a decompression mechanism on a branch path branching from the main refrigerant recovery path decompressing a residual refrigerant in the condenser, the decompressed refrigerant being sucked into the compressor and pressurized, and the pressurized refrigerant being sent into the refrigerant recovery container, an auxiliary heat exchanger configured to cool a refrigerant being connected near an outlet of the condenser and upstream of a junction between the main refrigerant recovery path and the branch path.

4. The apparatus of claim 3, wherein the auxiliary heat exchanger is configured as a water cooled condenser.

* * * * *